US007913847B2

(12) United States Patent
Kasboske

(10) Patent No.: US 7,913,847 B2
(45) Date of Patent: Mar. 29, 2011

(54) PACKAGING SYSTEM FOR AN OBJECT AND METHOD OF PACKAGING AN OBJECT

(76) Inventor: George Kasboske, Hickory Hills, IL (US)

( * ) Notice: Subject to any disclaimer, the term of this patent is extended or adjusted under 35 U.S.C. 154(b) by 189 days.

(21) Appl. No.: 11/787,365

(22) Filed: Apr. 16, 2007

(65) Prior Publication Data

US 2008/0251408 A1 Oct. 16, 2008

(51) Int. Cl.
*B65D 81/02* (2006.01)

(52) U.S. Cl. ..... 206/522; 206/591; 206/592

(58) Field of Classification Search ..... 206/522, 206/591, 521, 592, 523, 594; 229/87.02; 383/3

See application file for complete search history.

(56) References Cited

U.S. PATENT DOCUMENTS 4,738,359 A 4/1988 Phillips, Jr.
4,905,835 A * 3/1990 Pivert et al. ..... 206/522
5,180,060 A * 1/1993 Forti et al. ..... 206/522
5,624,035 A * 4/1997 Kim ..... 206/522
5,762,198 A * 6/1998 Hung ..... 206/522
5,769,232 A 6/1998 Cash et al.
5,806,683 A * 9/1998 Gale ..... 206/587
6,415,920 B1 * 7/2002 Tiramani et al. ..... 206/320
6,431,361 B1 * 8/2002 Wolf ..... 206/522
7,299,925 B1 * 11/2007 Ansay et al. ..... 206/522

OTHER PUBLICATIONS

International Search Report dated Jun. 30, 2008 in related PCT Application No. US2007/024419.

* cited by examiner

*Primary Examiner* — Mickey Yu
*Assistant Examiner* — Chun Cheung
(74) *Attorney, Agent, or Firm* — Wood, Phillips, Katz, Clark & Mortimer

(57) ABSTRACT

A packaging system in which an object can be maintained for shipping. The packaging system has a shell defining a space for reception of an object in a shipping state and an object engaging surface assembly that bounds at least a part of the space. The packaging system further has a fluid chamber assembly and a fluid within the fluid chamber assembly that has a variable pressure that is increased, thereby to cause the object engaging surface assembly to resiliently bear with increasing force against an object in the shipping state. The fluid within the fluid chamber assembly remains in a flowable state with the packaging system in a final state for shipping.

16 Claims, 11 Drawing Sheets

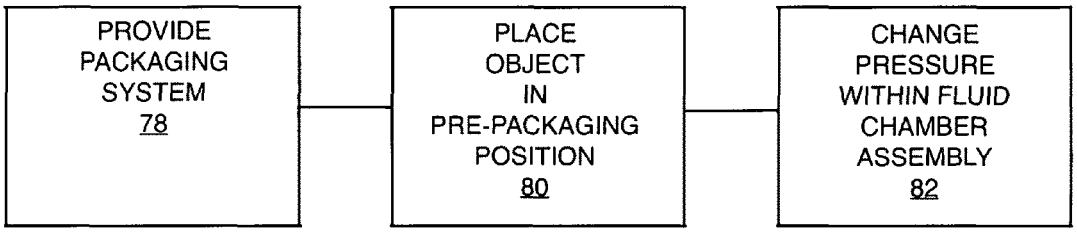
FIG 8
FIG 12
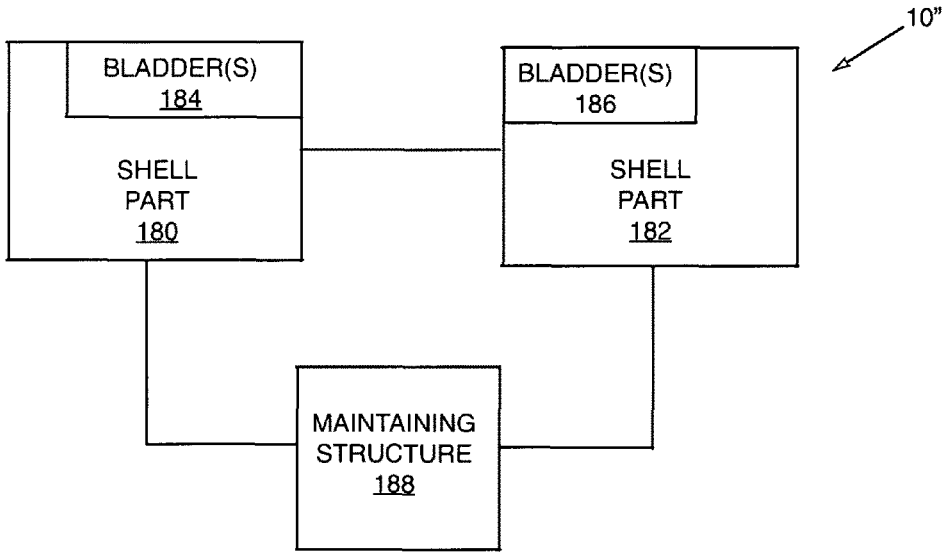

JOINING STRUCTURE 150
ATTACHING STRUCTURE 146
FLUID INLET 60"
VALVE 178
FLUID SUPPLY 58
MASTER CARTON 179
BLADDER 176
COVER PANEL 174

PACKAGING SYSTEM FOR AN OBJECT AND METHOD OF PACKAGING AN OBJECT

BACKGROUND OF THE INVENTION

1. Field of the Invention

This invention relates to packaging, and, more particularly, to a system and method for packaging one or more discrete objects for safe shipping thereof.

2. Background Art

Transportation of discrete objects that are prone to being damaged presents a challenge to individuals, businesses, and shipping companies worldwide. It is an age old practice to place an object within a shell, that may be made from paper, plastic, wood, metal, etc., and to protect the objects with cushioning materials that are interposed between the objects and shell. Cushioning materials have evolved and continue to evolve to address a number of different objectives.

First and foremost, the cushioning material must be effective in protecting objects as they are transported and handled.

Second, the packaging systems must be designed to be implemented in a manner that is reasonable both from the standpoint of logistics and cost.

Third, environmental considerations dictate packaging design. Once shipping components are utilized, they are ideally either disposed of without significant environmental impact or recycled for reuse.

These objectives have caused the development of numerous different types of cushioning materials. In the most primitive form, paper, such as newspaper, is crumbled and pressed between an object and a surrounding shell. At the destination location, the paper is commonly burned or recycled.

This practice has some inherent limitations. If there is a substantial gap between the object and the surrounding shell, a substantial amount of time and effort may be required to fill that space so as to effect proper cushioning. Depending upon the effort put forth by the individual carrying out the packaging, the effectiveness thereof may vary considerably from one package to the next.

Further, given the effort involved in recycling, shortcuts may be taken to dispose of the paper at the destination location, that may have an adverse environmental impact.

Still further, it is inconvenient, and potentially impractical, to keep on hand the necessary quantity of paper, particularly in high volume operations.

Still further, this packaging technique requires that the user press the paper somewhat firmly around the object that is being shipped. It is possible that with delicate objects a significant amount of damage may be inflicted at the point of packaging, as the paper is compacted in an attempt to conform it around the objects.

Bubble wrap has been used in a similar manner as paper and has some of the inherent drawbacks associated therewith. Bubble wrap is generally more effective than paper by reason of the fact that there are captured air pockets that contribute to the cushioning effect, whereas paper relies on inconsistently formed gaps between folds in the paper.

Bubble wrap is also relatively expensive and may have to be kept on site in large sheets or rolls. For individuals, it is an inconvenience to have to purchase the bubble wrap. For businesses and shipping companies, the needed supply of bubble wrap may take up valuable and expensive office and warehouse space.

While bubble wrap is often capable of being reused, it is often disposed of with common waste. This contributes detrimentally to the accumulation of plastics in landfills.

One of the most common packaging techniques utilizes discrete components, often referred to as "peanuts" made from styrofoam or other light-weight material. The peanuts are particularly desirable from the standpoint that they can be poured into a space around an object within a shell and are very light in weight. Nonetheless, a certain amount of skill is required to install the peanuts so there are no gaps that might allow shifting of the stored object.

One particular problem with the peanuts is that they potentially take up a large volume and are relatively difficult to store and deliver. A container of some sort must be provided to confine large volumes of the peanuts at shipping facilities. Equipment may also be required at the site where the peanuts are introduced to facilitate controlled delivery thereof into shells. Overhead funneling mechanisms are commonly used with a large hopper for this purpose. Commonly, bags of the peanuts are purchased and must be loaded into the delivery structure from overhead. This is potentially an awkward and time consuming process.

Because of the light weight of the peanuts, there is a tendency of the peanuts to be moved in response to even a slight draft. This may cause the peanuts to scatter undesirably in facilities in which they are used. Their light weight also makes it difficult to accumulate the peanuts during cleanup. This may be aggravated in the event that the peanuts become electrostatically charged, which commonly occurs. The peanuts in this condition tend to cling to shipped objects, and surfaces in the vicinity of where the objects are placed into, and removed from, a shell.

The light weight of the peanuts also creates a problem for the end user. Normally when one removes an object from a shell, a volume of the peanuts is usually caused to be discharged as well. The user is thus faced with the inconvenience of accumulating these peanuts and then effecting disposal thereof.

Styrofoam peanuts have not been routinely recycled. Unless the styrofoam peanuts are appropriately confined, they may scatter at curbside pick up locations and landfills where, if not recycled, they ultimately may end up. Styrofoam, and like composition components, have a detrimental environmental impact.

There are known types of peanuts that can be dissolved in water, or the like. Those at the ultimate destination may not take the time to dissolve the peanuts as intended and, in any event, contend with the problems associated with the light-weight nature of those peanuts.

It is also known to apply an adhesive to peanuts to maintain an aggregate shape after the peanuts are introduced. While this practice avoids the problem of scattering, some liner may be required to avoid unwanted exposure of the objects to the adhesive. Additionally, the unpacking process may be complicated by having to break loose the adhered peanuts without risking damaging of the objects within the shell. Re-use of the peanuts may be impractical. Proper disposal thereof thus becomes a problem.

Another known packaging technique utilizes a foam material that is formed at the packaging site about an object within a shell. A flexible liner is conformed around the object preparatory to introducing the foam which expands to conform to the space between the object and the shell. This technique is effective, but relatively costly by reason of requiring relatively expensive chemicals and components to store and control introduction thereof. This system may also generate large blocks of hardened foam that must be disposed of at the destination location.

Another technique for packaging utilizes loose, self-contained bladders, each with a predetermined quantity of air therewithin. The bladders are stuffed into the space between the objects and the shell to afford the desired cushioning. Commonly, the bladders are made from plastic. Multiple different sizes and shapes of bladders may have to kept on hand to meet all the different needs.

Additionally, there is a problem with reusing/recycling of these bladders which makes them often times an impractical option.

These bladders also suffer from the same limitations as do the basic components, discussed above, that require the user to strategically pack the cushioning components in the space between the objects and the shell.

As the volume of packages continues to increase on a worldwide level, the need to devise packaging systems that meet the above noted objectives increases.

SUMMARY OF THE INVENTION

In one form, the invention is directed to a packaging system in which an object can be maintained for shipping. The packaging system has a shell defining a space for reception of an object in a shipping state and an object engaging surface assembly that bounds at least a part of the space. The packaging system further has a fluid chamber assembly and a fluid within the fluid chamber assembly that has a variable pressure that is increased, thereby to cause the object engaging surface assembly to resiliently bear with increasing force against an object in the shipping state. The fluid within the fluid chamber assembly remains in a flowable state with the packaging system in a final state for shipping.

In one form, the packaging system is provided in combination with an object in the shipping state.

In one form, the fluid is in a gaseous form within the fluid chamber assembly.

In one form, the object engaging surface assembly has at least a portion that conforms against the object in the shipping state.

In one form, the fluid chamber is a part of the object engaging surface assembly and the object engaging surface assembly has: a) a first bladder with a first chamber and a first object engaging surface portion that bounds a first part of the space; and b) a second bladder with a second chamber and a second object engaging surface portion that bounds a second part of the space.

The object in the shipping state may reside captively between the first and second object engaging surface portions.

In one form, the shell has a plurality of panels that are folded relative to each other.

In one form, the shell is formed from a flat blank with a plurality of panels joined together at fold lines.

In one form, the shell is defined by a collapsible wall.

In one form, the fluid is air.

In one form, the first chamber is not in fluid communication with the second chamber.

Alternatively, the first chamber may be in fluid communication with the second chamber.

In one form, the first bladder is attached to the shell.

In one form, the shell has first and second panels with first and second surfaces that bound the space and the first bladder is provided on the first surface.

In one form, the second bladder is provided on the second surface.

In one form, the packaging system is provided in combination with a master carton for receiving the shell.

The invention is also directed to a method of packaging an object. The method includes the steps of: providing a packaging system with a shell, an object engaging surface assembly, and a fluid chamber assembly; placing an object in a pre-packaging position relative to the shell; and changing pressure of a fluid within the fluid chamber assembly thereby to cause the object engaging surface assembly to resiliently bear with increasing force against the object to thereby resiliently maintain the object in a shipping state in relationship to the shell while maintaining the fluid in a flowable state.

In one form, the step of providing a packaging system involves providing a packaging system with a shell in the form of a blank with a plurality of panels and folding the panels relative to each other to define a geometric shape with a plurality of flat surfaces bounding a space within which the object is maintained in the shipping state.

In one form, the step of providing a packaging system involves providing a packaging system with a shell having a flexible wall that is selectively collapsible and expandable.

In one form, the step of changing a pressure of the fluid involves introducing a fluid under pressure into the fluid chamber.

In one form, the step of providing a packaging system involves the step of discharging fluid from the fluid chamber assembly to facilitate separation of the object from the packaging system.

In one form, the step of providing a packaging system involves providing a packaging system with a fluid chamber assembly with first and second bladders, respectively with first and second chambers. The first and second bladders have first and second object engaging surfaces which bear against the object in the shipping state.

In one form, the step of changing pressure of a fluid involves introducing a fluid under pressure into the first chamber and causing the fluid under pressure to flow from the first chamber into the second chamber.

In one form, the step of changing pressure of a fluid involves introducing a fluid under pressure separately into each of the first and second chambers.

In one form, the step of providing a packaging system involves providing a packaging system having a fluid chamber assembly with a first bladder defining a first fluid chamber. The method may further include the step of attaching the first bladder to the shell.

BRIEF DESCRIPTION OF THE DRAWINGS

FIG. 8 is a flow diagram representation of a method of packaging an object according to the present invention;

FIG. 12 is a schematic representation of another form of packaging system, according to the present invention, in the form of a clam shell arrangement;

DETAILED DESCRIPTION OF THE DRAWINGS

Figure 1:
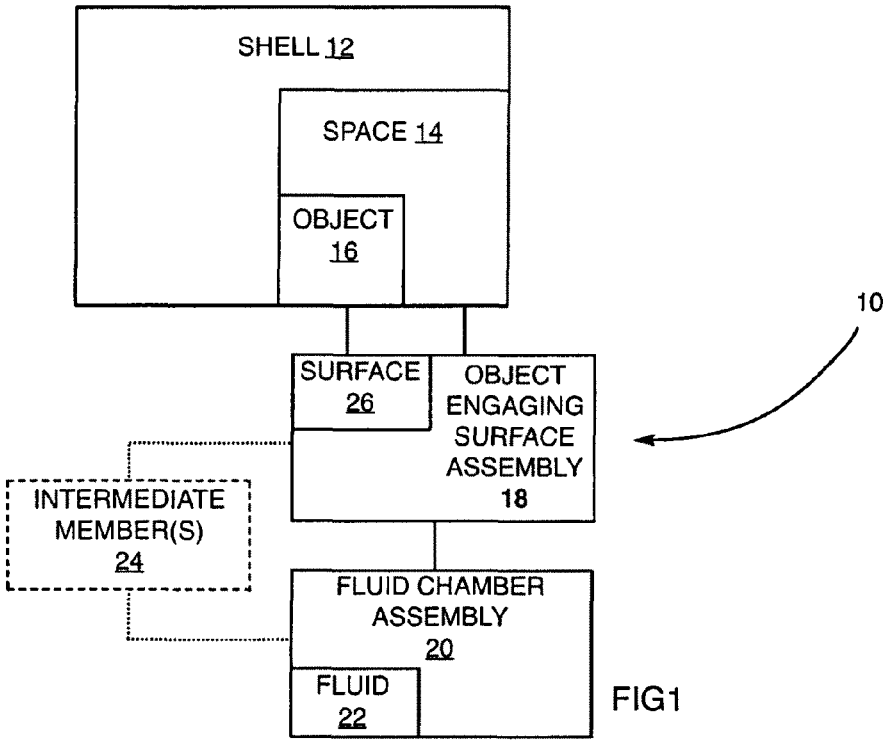
FIG. 1 is a schematic representation of one form of packaging system, according to the present invention, and including a shell, an associated object engaging surface assembly and fluid chamber assembly.

In one form, the invention is directed to a packaging system as shown schematically at 10 in FIG. 1. The packaging system 10 consists of a shell 12 defining a space 14 for reception of an object 16 placed therein in a shipping state. An object engaging surface assembly 18 bounds at least a part of the space 14. A fluid chamber assembly 20, that may be separate from or a part of the object engaging surface assembly 18, and shown in the former state in FIG. 1, has a fluid 22 therewithin that has a variable pressure that is increased, thereby to cause the object engaging surface assembly 18 to resiliently bear with increasing force against the object 16 in the shipping state. The fluid 22 within the fluid chamber assembly 20 remains in a flowable state with the packaging system 10 in a final state, wherein the object 16 is maintained by the packaging system 10 ready for shipping.

The precise fluid 22 that is used is not critical to the invention. In a preferred form, the fluid is in a gaseous form within the fluid chamber assembly 20. It is possible, but not preferred, for the fluid 22 to be in a liquid form, such as water.

The packaging system 10 is shown in schematic form given that the components described above may have a virtually unlimited number of variations consistent with the teachings herein. For example, the shell 12 may completely surround the space 14. Alternatively, the shell 12 may extend around only a part of the space 14. The shell 12 may be made from a relatively rigid material or one that is flexible and/or collapsible. The shell 12 may be made in a fixed configuration, or have relatively movable parts/panels that may be flat or contoured to make squared boxes, cylindrical tubes, or virtually any shape that may be generic in nature or designed specifically for a particular type of configuration of object or objects.

The pressure of the fluid 22 in the fluid chamber assembly 20 may be varied by introduction of the fluid 22, as from a pressurized source. Alternatively, by providing a discrete quantity of fluid 22 in the fluid chamber assembly 20, a part thereof may be reconfigured to increase pressure in a manner that causes the object engaging surface assembly to resiliently bear with an increasing force against the object 16.

The fluid 22 in the fluid chamber assembly 20 may act directly against the object engaging surface assembly 18 or optionally indirectly thereagainst through an intermediate member or members, as shown in dotted lines at 24 in FIG. 1.

The object engaging surface assembly 18 may be fully within the space 14 or partially outside thereof.

The object engaging surface assembly 18 has a surface 26 that directly engages the object 16. The surface 26 may be fixed in shape and resiliently urged against the object 16, or otherwise capable of conforming to contours of the object 16. More preferably, the surface 26 that defines at least a portion of the object engaging surface assembly 18 is constructed to readily conform against the object 16 in the shipping state therefor.

The nature of the object 16 is not in any way limiting. Any object, that can be placed in the space 14 such that there is a region within the space 14 around the object 16, in between the object 16 and shell 12, that is capable of receiving a cushioning material, in this case defined by the object engaging surface assembly 18 and fluid chamber assembly 20, is contemplated.

Figure 2:
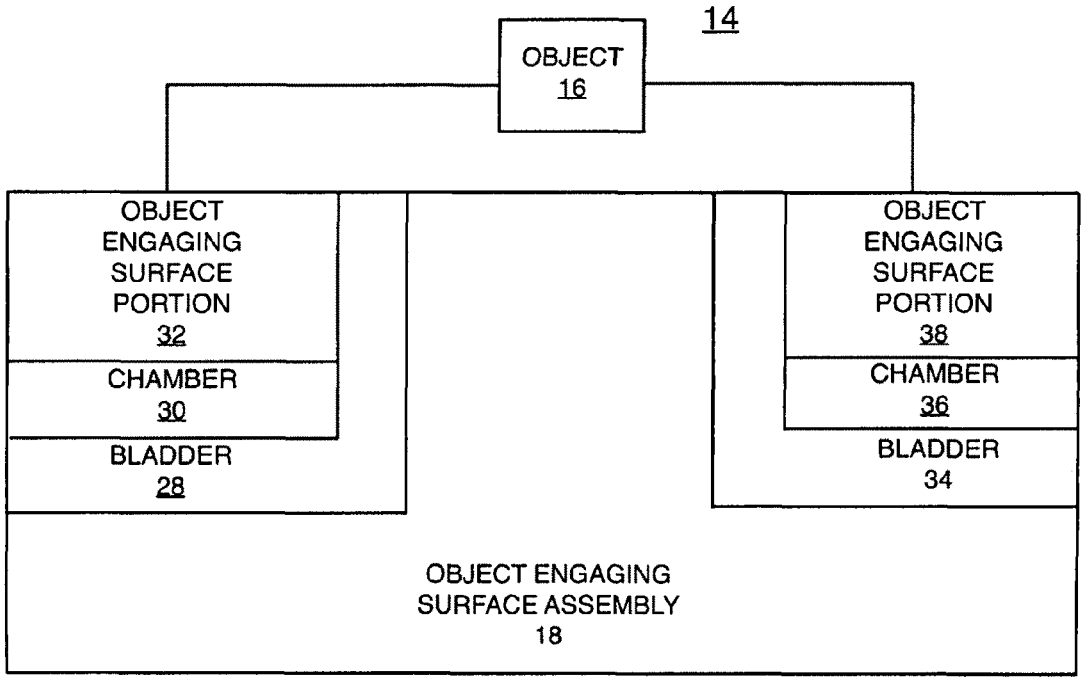
FIG. 2 is a schematic representation of the object engaging surface assembly on the packaging system in FIG. 1 with the fluid chamber assembly shown as a part thereof.

In one form, as shown in FIG. 2, the fluid chamber assembly is shown to be a part of the object engaging surface assembly 18 and the object engaging surface assembly 18 consists of a first bladder 28 with a first chamber 30 and first object engaging surface portion 32 that surrounds a first part of the space 14. The object engaging surface assembly 18 further includes a second bladder 34 with a second chamber 36 and a second object engaging surface portion 38 that bounds a second part of the space 14.

Within the space 14, the object engaging surface portions 32, 38 are borne against different regions of the object 16. In one preferred form, the object 16 resides captively between the first and second object engaging surface portions 32, 38.

As noted above, the shell 12 is not limited in its configuration or construction. All that is required is that there be some surface structure around the space 14 which allows the object engaging surface assembly 18 to act against the object 16 to maintain the same resiliently supported in the shipping state.

Figure 3:
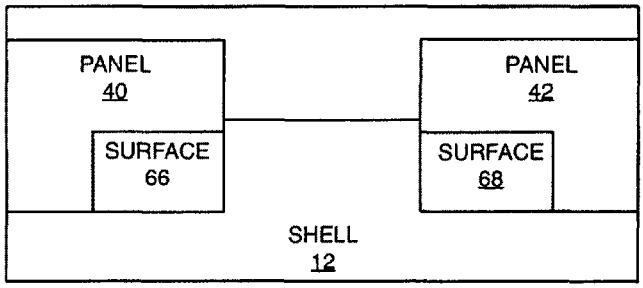
FIG. 3 is a schematic representation of the shell on the packaging system in FIG. 1.

As but one example, as shown in FIG. 3, the shell 12 may consist of two panels 40, 42, and potentially any additional number of panels, that can be folded relative to each other, as in a predetermined manner around fold lines, to extend around the space 14. The panels 40, 42 may be made from a hard material, such as wood, metal or plastic, or a more pliable material, such as cardboard, or the like. The panels 40, 42 are not limited in terms of their shape. They may be flat, curved, etc.

Figure 4:
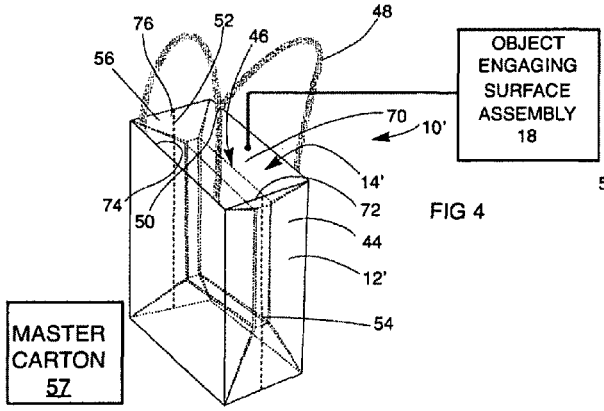
FIG. 4 is a perspective view of one form of shell, according to the invention, that is collapsible and shown in an expanded state.
Figure 5:
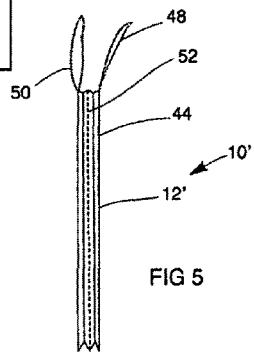
FIG. 5 is a side elevation view of the shell in FIG. 4 in a collapsed state.
Figure 20:
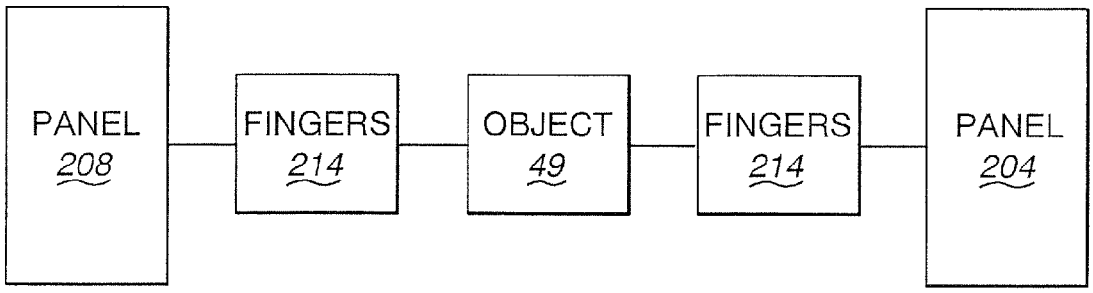
FIG. 20 is a view as in FIG. 19 with an object captively between bladders on the two panels.

Alternatively, as shown in FIGS. 4 and 5, a packaging system 10', with a modified form of shell 12', may be formed as an open, cup-shaped container with a peripheral wall 44 bounding a space 14' for an object 49 (see FIG. 20). The peripheral wall 44 may be changed from an expanded state, as shown in FIG. 4, to a collapsed state, as shown in FIG. 5. In the expanded state, an access opening 46 is provided for introduction of an object into the space 14'. The peripheral wall 44 may remain in the expanded state, allowing the user to carry the same through spaced handles 48, 50.

The peripheral wall 44 may be made from a flexible collapsible material and/or may include fold lines 52, 54 which facilitate collapsing in a predetermined manner without otherwise reconfiguring the peripheral wall 44.

The object engaging surface assembly 18 can be placed within the space 14' to function as previously described. The inside surface 56 of the peripheral wall provides a support upon which the object engaging surface assembly 18 can be attached or braced to facilitate maintaining of the object in the shipping state. For additional safety and security, the packaging system 10', like other packaging systems herein described, may be placed in a master carton 57.

Figure 6:
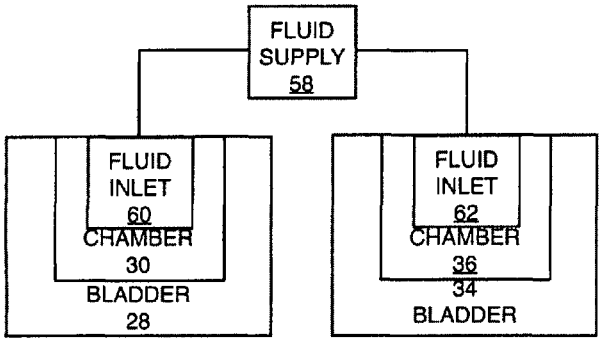
FIG. 6 is a schematic representation of a pair of bladders on the object engaging surface assembly on the packaging system in FIG. 2, with the bladders having chambers that communicate independently with a fluid supply.

As shown in FIG. 6, the chambers 30, 36 on the bladders 28, 34, respectively, may be independent so as not to be in fluid communication with each other. Fluid from a supply 58 is separately delivered through inlets 60, 62, associated respectively with the chambers 30, 36.

Figure 7:
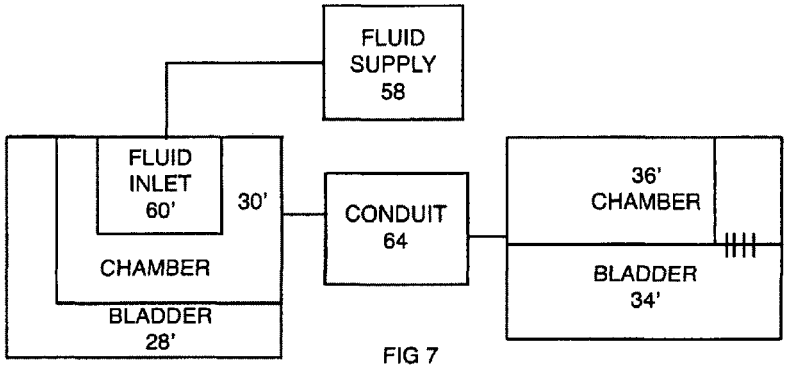
FIG. 7 is schematic representation of another form of bladder pair wherein fluid from a supply is introduced to the chamber within one bladder and flows therefrom into the other bladder.

Alternatively, as shown in FIG. 7, a modified form of corresponding bladders 28', 34' is shown with chambers 30', 36' that are in fluid communication with each other through a conduit 64. Fluid from the supply 58 is delivered through an inlet 60' to the chamber 30' and flows through the conduit 64 into the chamber 36'.

Any number of chambers can be provided into which fluid is supplied individually or where the fluid flows from one to the next. The structure shown in FIG. 7 is desirable from the standpoint that it allows a simplified reconfiguration of the packaging system to cause the packaging system to be placed in a final state for shipping.

The exemplary bladders 28, 34 may be attached each to one of the panels 40, 42 on the shell 12 shown in FIG. 3. As one example, the panels 40, 42 may, with the packaging system in a final state, have surfaces 66, 68, respectively, that bound the space 14, to which the bladders 28, 34 are attached, or against which the bladders 28, 34 bear without any type of fixed attachment. For example, the bladder 28 might be adhesively bonded to the surface 66, on the panel 40, with the bladder 34 adhesively bonded to the surface 68 on the panel 42.

This same arrangement can be used with the shell 12' shown in FIGS. 4 and 5. For example, bladders (not shown) can be attached to any of the portions 70, 72, 74, 76 of the inside surface 56.

With the structure described above, the following method of packaging an object can be performed, as shown in flow diagram form in FIG. 8. As shown at block 78, a packaging system is provided, which may be one consisting of the aforementioned shell 12, object engaging surface assembly 18, and fluid chamber assembly 20. As shown at block 80, the object is placed in a pre-packaging position. Thereafter, as shown at block 82, the pressure of the fluid within the fluid chamber assembly 20 is changed, thereby to cause the object engaging surface assembly 18 to resiliently bear with increasing force against the object 16, to thereby resiliently maintain the object 16 in a shipping state in relationship to the shell 12. The fluid is maintained in the flowable state with the packaging system 10 in its final state for shipping.

Figures 9, 10, 11:
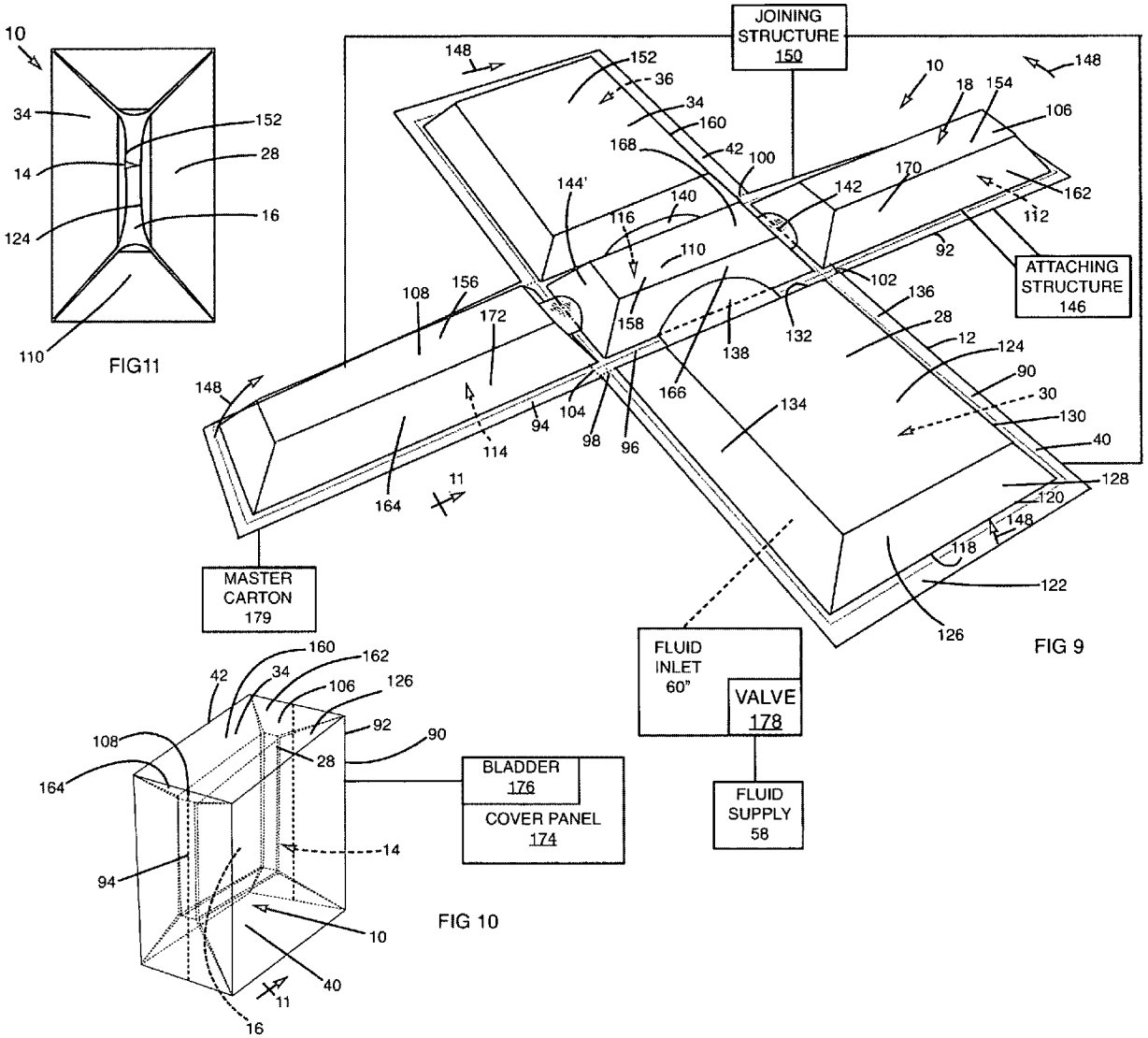
FIG. 9 is a perspective view of one specific form of packaging system, according to the invention, with a shell having an object engaging surface assembly associated therewith preparatory to forming the shell into an operative state.
FIG. 10 is a perspective view of the packaging system in FIG. 9 in an operative state.
FIG. 11 is a cross-sectional view of the packaging system taken along lines 11-11 of FIG. 10.

A more specific form of the basic packaging system 10 is shown in FIGS. 9-11. In this embodiment, the shell 12 is formed from a blank 90 of flat material, that may be cardboard, or the like. The blank 90 is formed into a "T" shape with side panels 40, 42, 92, 94 and a bottom panel 96. The panels 90, 92, 94, 96 are each foldable relative to the bottom panel 96 about fold lines 98, 100, 102, 104, respectively, at which locations the blank 90 may be locally weakened to cause consistent folding to take place between the side panels 40, 42, 90, 92 and bottom panel 96.

The object engaging surface assembly 18 consists of a plurality of bladders 28, 34, 106, 108, each associated with one of the panels 40, 42, 92, 94, respectively. The bottom panel 96 has an associated bladder 110. Each of the bladders 28, 34, 106, 108, 110 bounds a chamber 30, 36, 112, 114, 116.

The bladders 28, 34, 106, 108, 110 have the same general construction. Exemplary bladder 28 has a truncated pyramidal shape with a base 118 having a flat surface 120 that is attached to a surface 122 on the panel 40. A flat surface 124 faces oppositely to the surface 120 on the base 118. A peripheral wall 126 extends continuously around the base 118 and flat surface 124 and connects therebetween. The peripheral wall 126 has flat, angled wall portions 128, 130, 132, 134.

In this embodiment, the object engaging surface assembly 18 is shown as a single unit that can be secured to the blank 90 on one side 136 thereof. Conduits 138, 140, 142, 144 respectively establish fluid communication between the chambers 30, 36, 112, 114 and the chamber 116 on the bladder 110 on the bottom panel 96. As noted above, it is possible for all of the chambers to be isolated from each other so that the pressure variation must be separately accomplished for each.

The bladders 28, 34, 106, 108, 110 may be made from a readily foldable and collapsible material, such as plastic sheet material, that will retain the operating fluid, which is preferably air. The object engaging surface assembly 18 need not be secured to the blank 90. However, in a preferred form, the object engaging surface assembly 18 is secured to the blank 90 through an appropriate attaching structure 146, which may be an adhesive, or any other means known to those skilled in the art.

In one exemplary operation, the object engaging surface assembly 18 is attached to the blank 90 as shown, whereupon the side panels 40, 42, 92, 94 are folded upwardly about their respective fold lines 98, 100, 102, 104 in the direction of the arrows 148 to produce a generally squared geometric shape shown in FIGS. 10 and 11, thereby cooperatively defining the space 14 for reception of the object 16 in a shipping state, as shown in FIGS. 10 and 11. This represents the operative state for the packaging system 10 and shell 12.

The panels 40, 42, 92, 94, 96 can be maintained in the operative state, shown in FIGS. 10 and 11, by any suitable joining structure 150. The joining structure 150 may be cooperating flaps between the panels 40, 42, 92, 94, 96 that are secured as by an adhesive, a band, tape, etc. The forming of panels into an operative state may be accomplished in a multitude of different manners, all of which are contemplated, and none of which is critical to the present invention.

With the shell 12 in the operative state, the bladders 28, 34, 106, 108, 110 interact with each other to produce a continuous surface bounding the space 14 that is defined cooperatively by the surface 124 on the bladder 28, and corresponding surfaces 152, 154, 156, 158, respectively on the bladders 34, 106, 108, 110. The angled arrangement of the peripheral wall 126 on the bladder 28, and corresponding peripheral walls 160, 162, 164, 166 on the bladders 34, 106, 108, 110, causes the bladders 28, 34, 106, 108, 110 to interengage through complementary wall portions and thereby become mutually reinforcing. That is, with the shell 12 in the operative state, the flat, angled wall portion 132 facially engages a flat, complementarily angled wall portion 168 on the peripheral wall 166 on the bladder 110. The flat, angled wall portion 130 facially engages a flat, complementarily angled wall portion 170 on the peripheral wall 162 on the bladder 106. The flat, angled wall portion 134 facially engages a flat, complementarily angled wall portion 172 on the bladder 108. The bladders 28 and 34, 106, 108, 110 can be configured to interact in a like manner.

The bladders 28, 34, 106, 108, 110 can initially be in a flattened state as the shell 12 is placed in the operative state. Alternatively, a preliminary low pressure can be established for the fluid in each of the bladder chambers 30, 36, 112, 114, 116 to facilitate their interconnection. Before the object 16 is placed in a shipping state, it is preferred that the chamber 116 on the bladder 110 be filled with the pressurized fluid sufficiently that the weight of the object 16, placed thereagainst in a pre-packaged position, does not cause the surface 158 to deflect downwardly into close proximity to the side 136 of the blank 90. By increasing the pressure in some, and preferably all, of the chambers 30, 36, 112, 114, 116, the surfaces 124, 152, 154, 156, 158 bear against the object 16 and are caused to be conformed therearound to closely envelop the object 16 and maintain the object 16 in spaced relationship from the side 136 of the blank 90 around the entire peripheral extent of the object 16. The fully enveloped object 16 "floats" on a cushion of the pressurized fluid within the space 14. The object 16 is prevented from shifting by reason of the captive engagement thereof between the facing surface pairs 124, 152, 154, and 156.

It should be understood that the depicted configuration of the bladders 28, 34, 106, 108, 110 is not intended to be limiting. As one example, rather than a truncated pyramidal shape, one or all of the bladders 28, 34, 106, 108, 110, might be shaped as a portion of a sphere. There can be individual, discrete bladders associated with one or more of the panels 40, 42, 92, 94, 96 having a completely different shape. All that it is critical to the present invention is the ability to change the pressure of the chambers associated with the bladders to allow the object 16 to be at least partially enveloped and held in the shipping state on a cushion of the fluid, which remains in a flowable state. Only limited shifting of the object 16 within the space 14 is made possible by the flowable nature of the fluid.

In FIG. 10, a cover panel 174 is shown to be formed either as part of the blank 90, or as a separate element that is attached after the shell 12 is placed in the operative state and the final fluid pressure set for the bladder chambers. The cover panel 174 may have a bladder 176 containing fluid with a fixed or variable pressure. The bladder 176 may be complementary in shape to the peripheral walls 126, 160, 162, 164 so that the bladder 176 nests thereagainst with the cover panel 174 in place.

The pressurized fluid may be introduced to any one of the chambers 30, 36, 112, 114, 116 for distribution into the remaining chambers. As just one example, a fluid inlet 60" may be provided to communicate pressurized fluid from the fluid supply 58 into the chamber 30, associated with the bladder 28. The fluid inlet 60" may have a one way valve 178 that can be actuated by a needle, or the like, in communicating fluid from the supply 58. The valve 178 may also be reconfigurable to allow release of the pressurized fluid from the chamber 30. This may be accomplished to relieve the pressure in the bladders 28, 34, 106, 108, 110 to facilitate separation of the object 16 from the space 14 once the object 16 within the packaging system 10 arrives at the desired destination.

The structure shown in FIGS. 9-11 represents one of virtually a limitless number of different foldable shapes that might be utilized for the shell and associated object engaging surface assembly. All that is desired is that there be some form of shell, with a plurality of panels that can be moved relative to each other to define a geometric shape with a plurality of surfaces, that may be flat or any other shape, bounding a space within which an object can be captively enveloped by a cushion of the fluid. Of course, the shell could be pre-formed in a desired geometric shape without the requirement of folding.

As just one example, the panels 92, 94, and associated bladders 106, 108 might be eliminated so that the shell in its operative state is simply U-shaped. The U-shaped shell might be shipped in that manner or surrounded by a separate component, such as a master carton 179 that defines a part of the shell.

As a further alternative form, as shown in FIG. 12, a packaging system 10" may consist of joinable shell parts 180, 182 that are joinable in a clam shell arrangement. Each of the shell parts 180, 182 has one or more associated bladders 184, 186, respectively. Through a suitable maintaining structure 188 the shell parts 180, 182 are held together in an operative state wherein the associated object 16 in its shipping state is captive between the shell parts 180, 182 and supported on a cushioning fluid around its peripheral extent.

Figure 13:
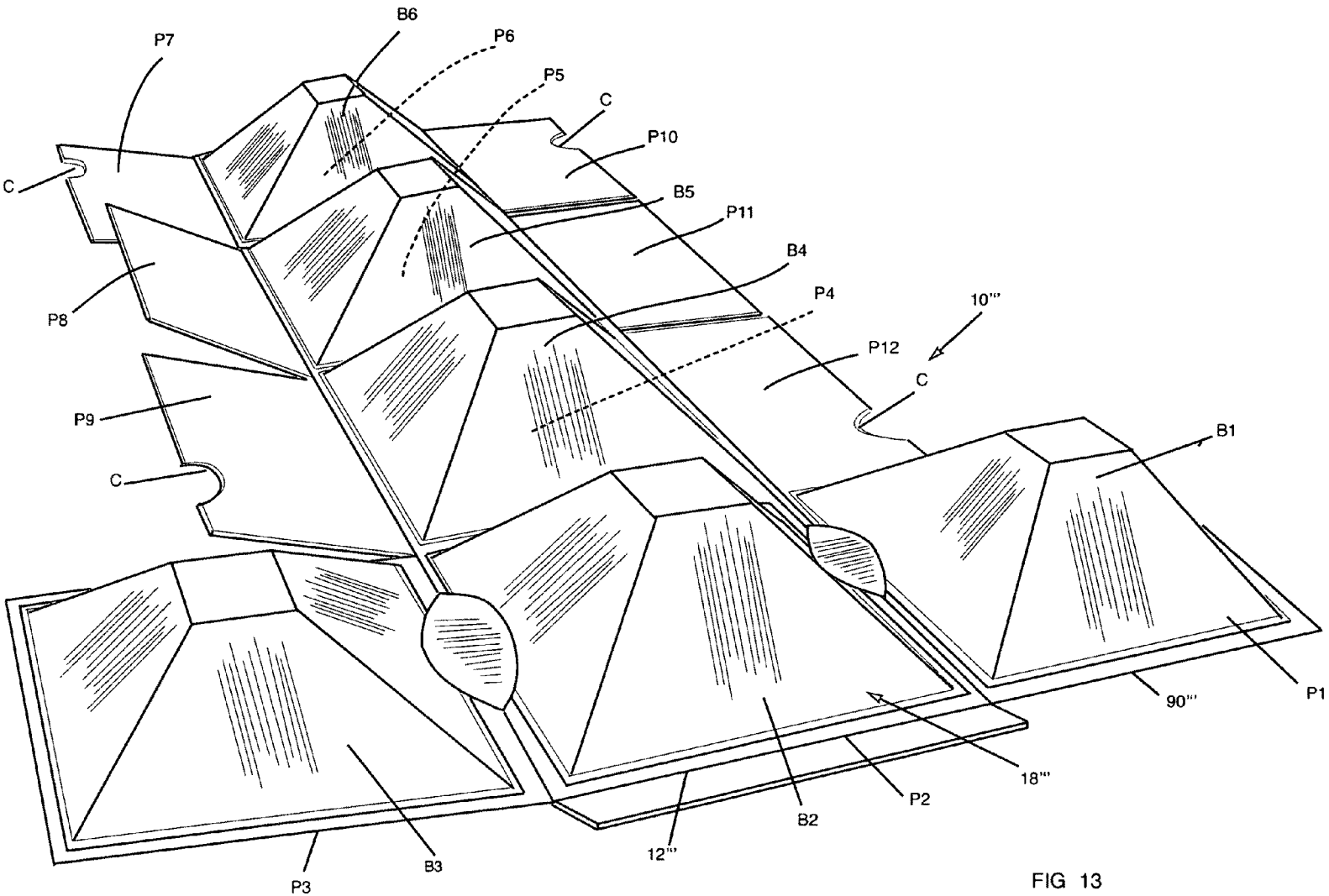
FIG. 13 is a perspective view of another form of packaging system, according to the invention, consisting of a shell and object engaging surface assembly preparatory to forming the shell into an operative state.
Figure 14:
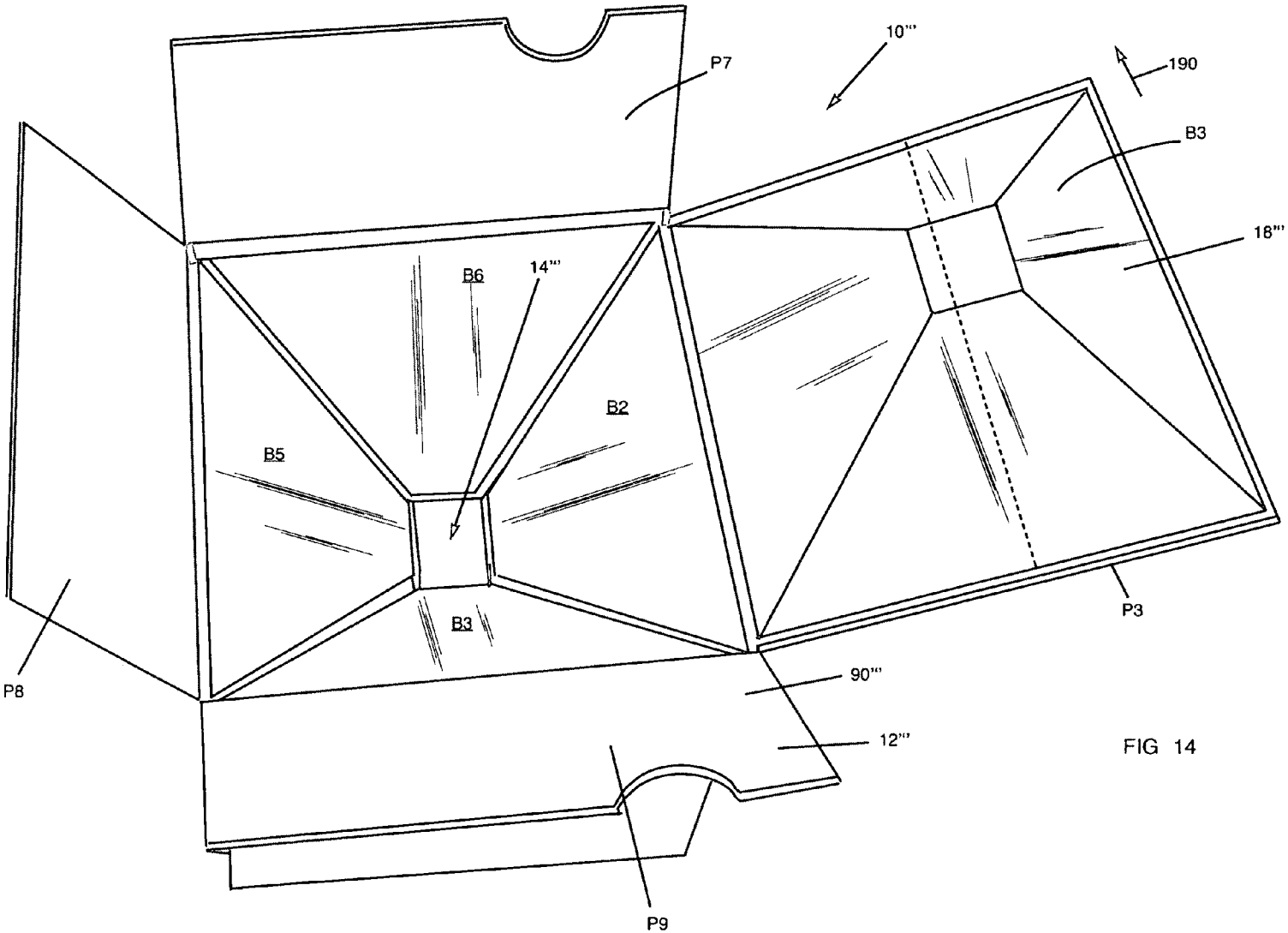
FIG. 14 is a perspective view of the packaging system in FIG. 13 with the shell in an operative state.
Figure 15:
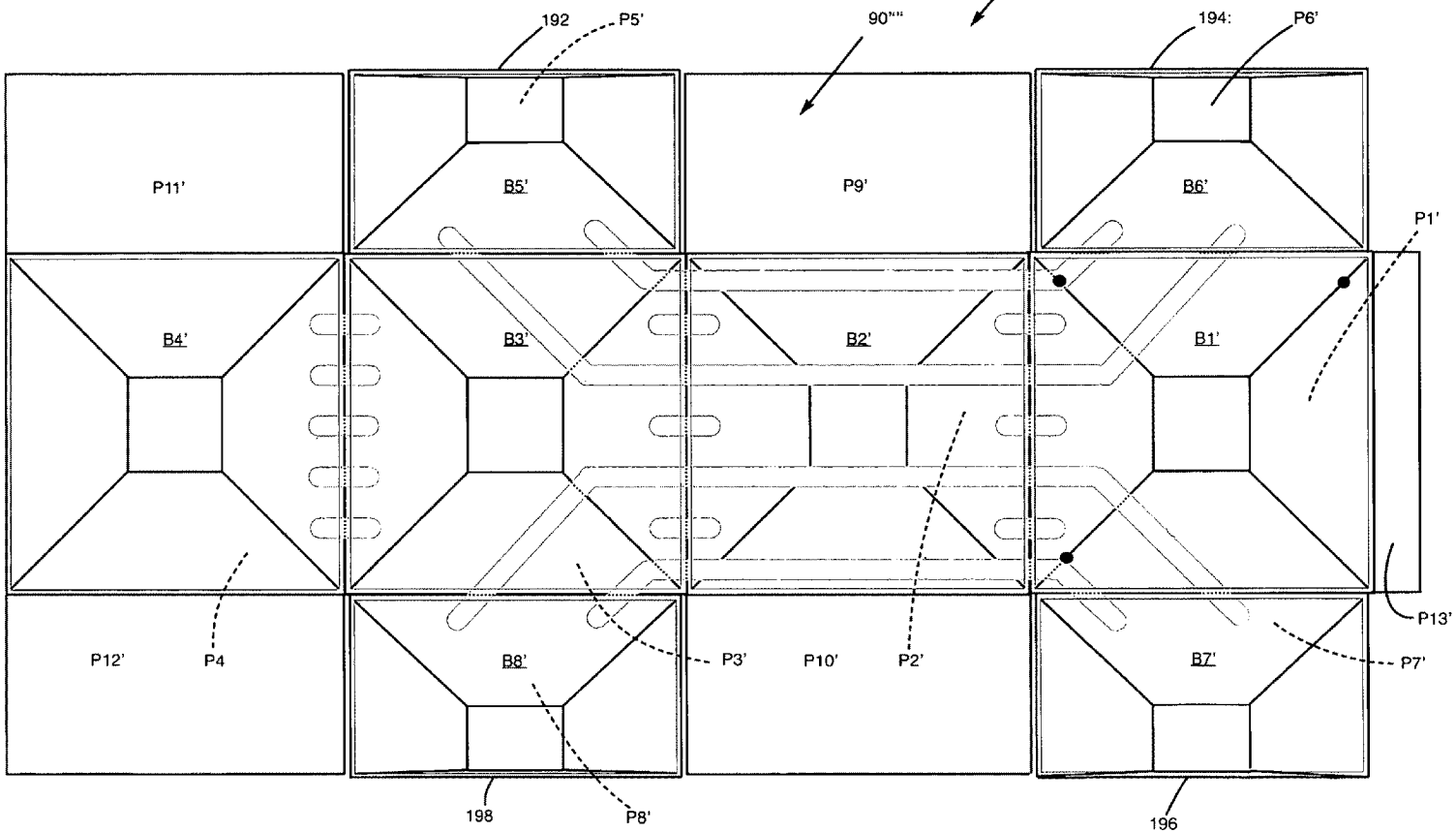
FIG. 15 is a plan view of yet another form of packaging system, according to the invention, consisting of a shell and object engaging surface assembly.
Figure 16:
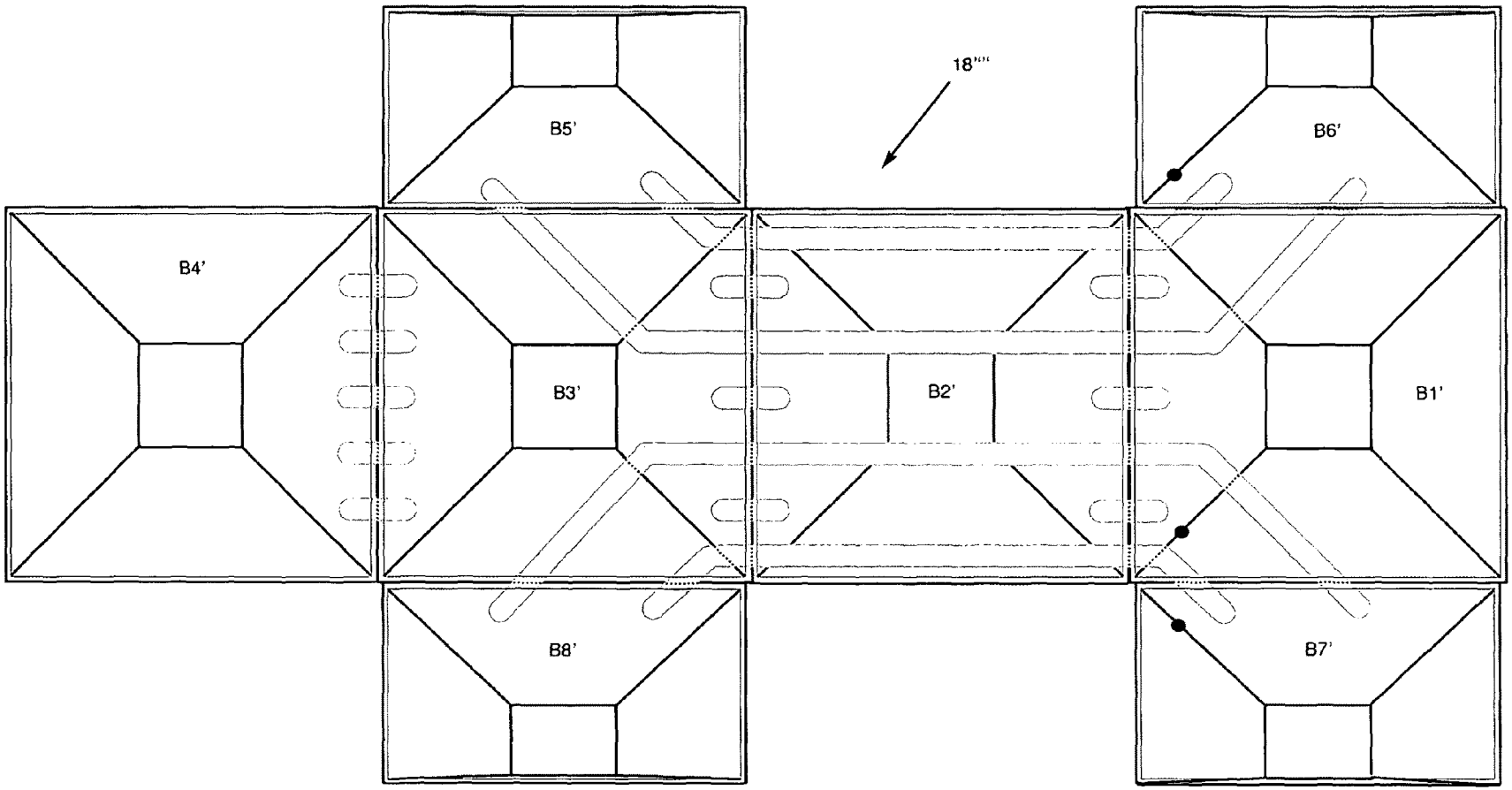
FIG. 16 is a plan view of the object engaging surface assembly separated from the shell in FIG. 15.

In FIGS. 13 and 14, a further form of packaging system is shown at 10''' with a shell 12''' and object engaging surface assembly 18'''. The packaging system 10" consists of a blank 90''' with twelve (12) relatively foldable, generally flat panels (P1-P12). Chambered bladders B1, B2, B3, B4, B5, B6 are associated one each with the panels P1-P6. The panels P1-P12 are folded relative to each other from the FIG. 13 orientation to the FIG. 14 orientation, wherein a space 14''' is defined for the object 16. Once the object 16 is introduced into the space 14''', the panel P3, which serves as the cover panel, and its associated bladder B3, is pivoted in the direction of the arrow 190 over the top of the space 14'''. The panel P8 is then folded over the panel P3. The panels P7 and P9 are in turn folded over the panel P8, thereby to place the packaging system 10''' in a final state for shipping. The panels P7, P9, P10 and P12 have cutouts C that facilitate access to any fluid inlet/outlet valve at the top and bottom of the completed packaging system 10'''. In FIGS. 15 and 16 a further modified form of packaging system is shown at 10'''' with an object engaging surface assembly 18''''. The packaging system 10'''' is designed to produce substantially the same configuration as the packaging system shown at 10''' in FIGS. 13 and 14. The packaging system 10'''' uses a slightly different folding arrangement.

More specifically, the packaging system 10'''' uses a blank 90'''' with eight (8) panels P1'-P8' each having associated therewith one bladder B1'-B8'. Bladders B5'-B8' have the same general configuration as the bladders B1'-B4', but are cut in half to each fit a complementarily-shaped panel P5'-P8'.

The panel P2' defines the bottom of the packaging system 10''''. The panels P5', P6', P1', P7', P8' and P3' extend continuously around the bottom panel P2' to define a continuous peripheral wall. The bladders B5', B6', B1', B7', B8', B3' extend continuously within that peripheral wall and bound the space 14'''' for the object 16. The panel P9', P10' project oppositely from the panel P2', and are foldable relative thereto to reinforce the peripheral wall. The panel P9' overlies a seam defined cooperatively by the edges 192, 194 on the panels P5', P6'. The panel P10' similarly overlies a seam defined by adjacent edges 196, 198 on the panels P7', P8'.

The panel P4' defines the cover panel. The panels P11', P12' project oppositely from the panel P4' and are foldable relative thereto. With the cover panel P4' closed, the panel P11' can be folded downwardly against a peripheral wall to overlie the seam defined at the edges 192, 194. The panel P12' can be folded downwardly to likewise overlie the seam defined by the adjacent edges 196, 198. A panel P13' can be folded over the cover panel P4' for additional reinforcement.

Figure 17:
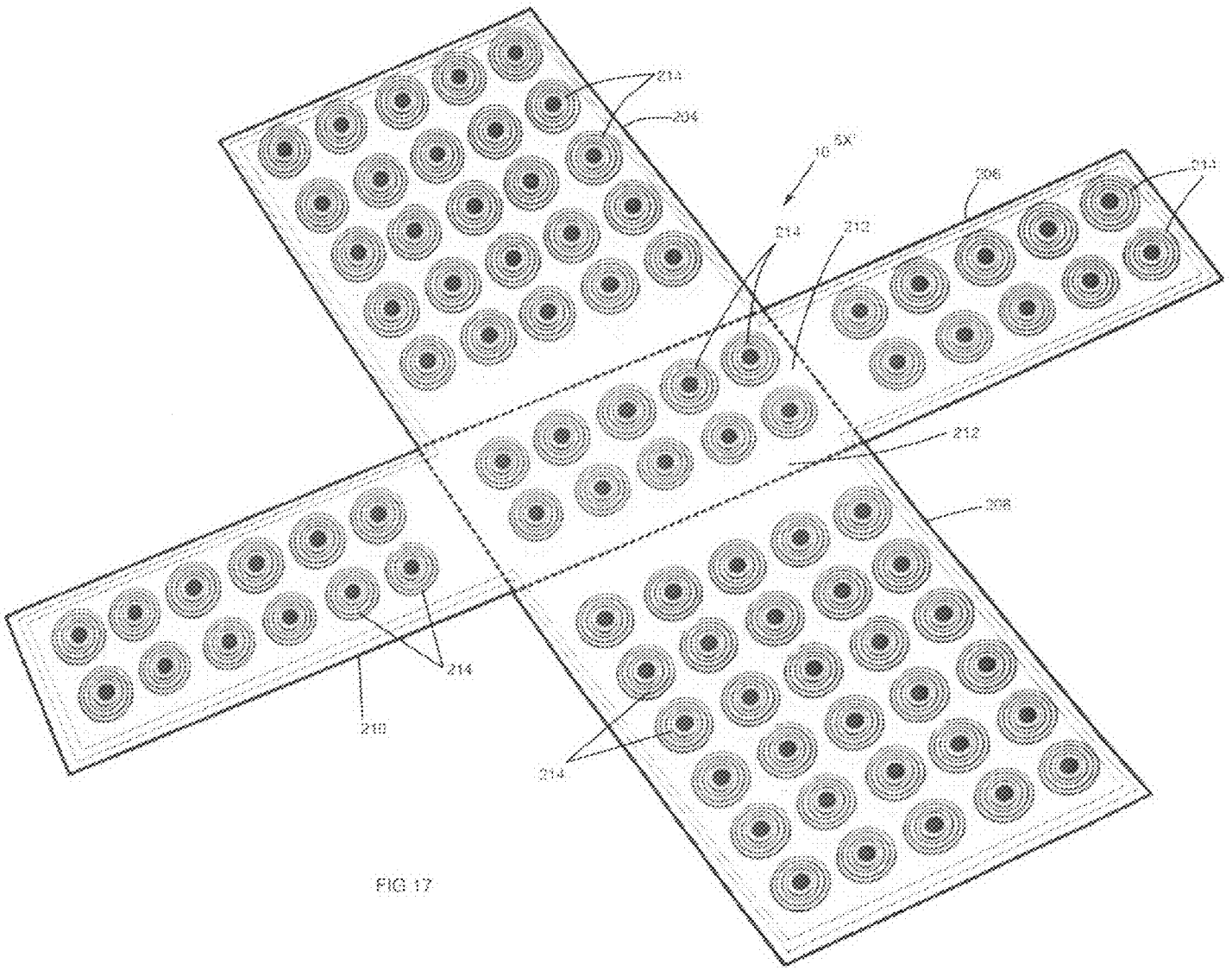
FIG. 17 is a perspective view of a further modified form of packaging system according to the invention, similar to that in FIG. 9, wherein a plurality of panels on the shell each has a plurality of bladders shown in a collapsed, flattened state.
Figure 18:
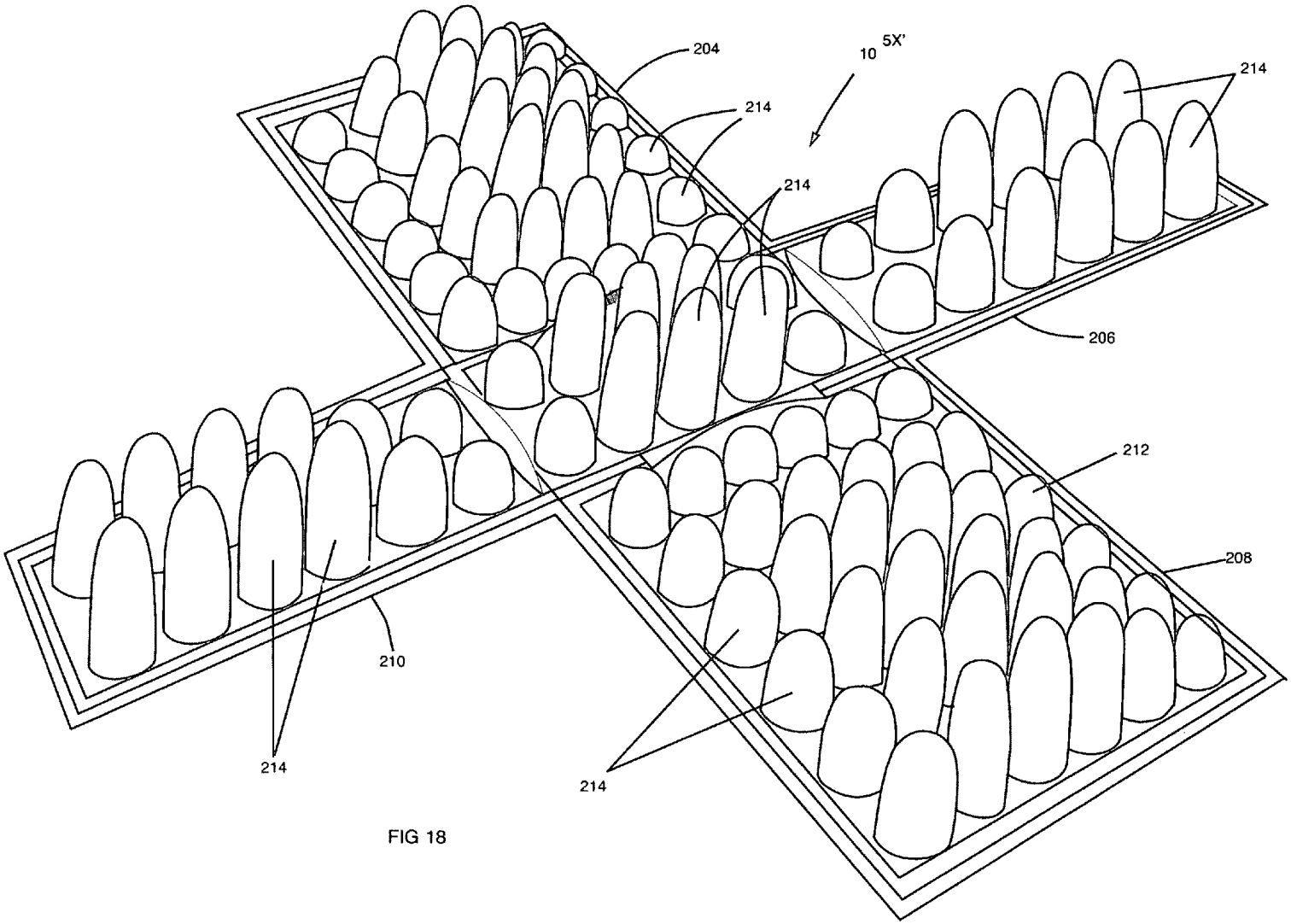
FIG. 18 is a view as in FIG. 17 with its bladder pressurized to an expanded state.
Figure 19:
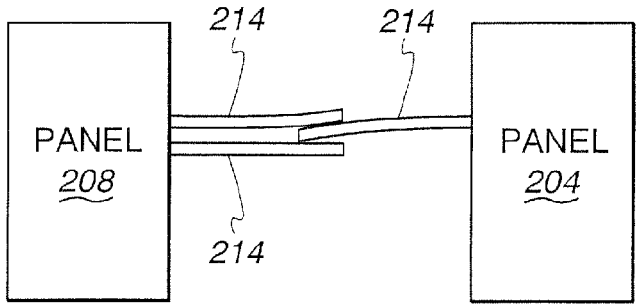
FIG. 19 is a schematic representation of two panels, as shown in FIG. 18, with bladders on the two panels intermeshed.

In FIGS. 17 and 18, a further modified form of packaging system is shown at $10^{5xi}$. The packaging system $\mathbf{10}^{5xi}$ has a T-shaped blank 202 similar to the blank 90 in FIGS. 9-11, with panels 204, 206, 208, 210, 212 that are relatively foldable, from the state in FIGS. 17 and 18, to an operative state.

Instead of providing a single bladder on each panel, multiple bladders 214 are provided on each panel 204, 206, 208, 210, 212 and are changeable between a collapsed/flattened state, as shown in FIG. 17, and a pressurized state as shown in FIG. 18. The individual bladders 214 may be in fluid communication with each other or isolated. Alternatively, strategic fluid communication may be established between certain of the bladders 214 to facilitate enveloping of certain object shapes by the bladders 214.

The individual bladders 214 act as discrete fingers that individually project from their respective panels to an extent to potentially conform more readily to different, complex shapes. Potentially, the bladders 214 on adjacent panels 204, 206, 208, 210, 212 intermesh to more firmly engage an object.

The bladders/fingers 214 each has: a) an elongate, generally cylindrical shape; b) a length projecting from its respective panel; and c) a rounded free end remote from the panel from which it projects. As seen in FIG. 18, the projecting lengths may be different. As seen in FIG. 17, the footprints of the bladders 214 on their respective panels are spaced from each other so that there is a gap between the footprints. As seen in FIG. 18, the inflated bladders 214, in their pressurized states, are likewise spaced from each other along their lengths, including at their free ends. The bladders 214 have diameters transversely to their lengths. The lengths of the bladders 214 are substantially greater than their diameters.

The foregoing disclosure of specific embodiments is intended to be illustrative of the broad concepts comprehended by the invention.

The invention claimed is:

1. A packaging system in which an object can be maintained for shipping, the packaging system comprising:

a shell defining a space for reception of an object in a shipping state and comprising a plurality of panels;

an object engaging surface assembly that bounds at least a part of the space;

a fluid chamber assembly that is part of the object engaging surface assembly; and a fluid within the fluid chamber assembly that has a variable pressure that is increased, thereby to cause the object engaging surface assembly to resiliently bear with increasing force against an object in the shipping state, the fluid within the fluid chamber assembly remaining in a flowable state with the packaging system in a final state for shipping, wherein the object engaging surface assembly comprises a plurality of discrete fingers on at least one of the panels that resiliently bear against an object in the shipping state, each of the fingers comprising a bladder that contains the fluid, wherein the fingers on the one panel have a length projecting away from the one panel, the fingers spaced from each other along the length of the fingers, wherein the fingers on separate panels intermesh with each other, wherein the object engaging surface assembly further comprises a plurality of fingers each comprising a bladder in which the fluid is contained on a second panel on the shell and the object in the shipping state resides captively between the fingers on the one and second panels, wherein fingers on the one panel intermesh with fingers on the second panel, wherein the one and second panels respectively have first and second facing surfaces between which an object in the shipping state resides, wherein the fingers on the one panel project from the first surface towards the second surface and intermesh with the fingers on the second panel that project from the second surface towards the first surface.

2. The packaging system according to claim 1 in combination with an object in the shipping state.

3. The packaging system according to claim 2 wherein the fluid is in a gaseous form within the fluid chamber assembly.

4. The packaging system according to claim 2 wherein the plurality of discrete fingers conforms against the object in the shipping state.

5. The packaging system according to claim 2 in combination with a master carton for receiving the shell in the space.

6. The packaging system according to claim 1 wherein the shell comprises a flat blank with the plurality of panels joined together at fold lines.

7. The packaging system according to claim 1 wherein the shell is defined by a collapsible wall.

8. The packaging system according to claim 1 wherein the fluid comprises air.

9. The packaging system according to claim 1 wherein at least one finger on the one panel is in fluid communication with at least another finger on the one panel.

10. The packaging system according to claim 1 wherein at least one finger on the one panel is not in fluid communication with at least another finger on the on panel.

11. The packaging system according to claim 1 wherein at least one finger on the one panel is in fluid communication with at least another finger on the second panel.

12. The packaging system according to claim 1 wherein at least one finger on the one panel is not in fluid communication with at least another finger on the second panel.

13. The packaging system according to claim 1 wherein the fingers have an elongate, generally cylindrical shape with a diameter and the lengths are substantially greater than the diameters.

14. A method of packaging an object, the method comprising the steps of:

providing a packaging system comprising a shell comprising a blank with a plurality of panels, an object engaging surface assembly defined by a plurality of discrete, elongate fingers on at least one and another of the panels and a fluid chamber assembly, the elongate fingers having lengths projecting away from the one panel and the another panel, the elongate fingers from the one and another panel projecting towards each other so that the elongate fingers on the one and another panels intermesh;

placing an object in a pre-packaging position relative to the shell;

changing pressure of a fluid within the fluid chamber assembly thereby to cause the fingers on the object engaging surface assembly to resiliently bear with increasing force against the object to thereby resiliently maintain the object in a shipping state in relationship to the shell while maintaining the fluid in a flowable state by at least separately varying an amount of projection of the fingers from the at least one panel.

15. The method of packaging an object according to claim 14 wherein the step of providing a packaging system comprises providing a packaging system with an object engaging surface assembly defined by a plurality of discrete fingers that are fully spaced from each other.

16. The method of packaging an object according to claim 14 wherein the fingers on the one panel are spaced from each other along the lengths of the fingers, the fingers have a diameter transversely to their length and the lengths are substantially greater than the diameters and the one and another panels have facing surfaces between which the object resides and from which the elongate fingers on the one and another panel project.

* * * * *